US011751656B2

(12) United States Patent
McBride

(10) Patent No.: US 11,751,656 B2
(45) Date of Patent: Sep. 12, 2023

(54) HAIR CROCHET APPARATUSES AND METHODS

(71) Applicant: Jenise McBride, Lithonia, GA (US)

(72) Inventor: Jenise McBride, Lithonia, GA (US)

( * ) Notice: Subject to any disclaimer, the term of this patent is extended or adjusted under 35 U.S.C. 154(b) by 254 days.

(21) Appl. No.: 16/936,128

(22) Filed: Jul. 22, 2020

(65) Prior Publication Data

US 2021/0037943 A1 Feb. 11, 2021

Related U.S. Application Data

(60) Provisional application No. 62/883,586, filed on Aug. 6, 2019.

(51) Int. Cl.
*A45D 2/00* (2006.01)

(52) U.S. Cl.
CPC ..... *A45D 2/00* (2013.01); *A45D 2002/005* (2013.01)

(58) Field of Classification Search
CPC ..... D04B 3/02; B25G 1/08; A41G 5/0086; A41G 5/006; A43G 5/0066; A45D 2/00; A61B 2017/0046; B65H 67/065
See application file for complete search history.

(56) References Cited

U.S. PATENT DOCUMENTS 1,420,893 A * 6/1922 Till ..... D04B 3/02 279/81
1,564,379 A * 12/1925 Stephens ..... D04B 17/04 66/117
1,620,550 A * 3/1927 Howe ..... D04B 17/04 66/117
1,682,985 A * 9/1928 Rollins ..... D04B 17/04 66/117
1,692,220 A * 11/1928 Osberg ..... D04B 17/04 66/121
1,704,790 A * 3/1929 Cook ..... D04B 17/04 66/121
2,252,302 A * 8/1941 Morith ..... D04B 17/04 236/1 A
2,465,636 A * 3/1949 Doerr ..... D04B 3/00 66/118
3,860,155 A * 1/1975 Migliaccio ..... D04G 3/02 223/104
6,454,330 B1 * 9/2002 Chen ..... B25J 1/04 294/104
7,013,516 B1 * 3/2006 Peters ..... B25G 1/08 7/164
7,261,349 B1 * 8/2007 Gregor ..... B25B 9/00 294/100

(Continued)

*Primary Examiner* — Nicholas D Lucchesi
(74) *Attorney, Agent, or Firm* — Troutman Pepper Hamilton Sanders LLP; Ryan A. Schneider; Andrews C. Doherty

(57) ABSTRACT

An apparatus for crocheting hair that can be used to efficiently and safely crochet hair extensions into cornrow braids. The apparatus can include a handle comprising a first end, a second end, and a connection receptacle located proximate to an attachment receptacle. The handle can further comprise the attachment receptacle located at the first end of the handle and configured to receive an attachment feature of the detachable member, as well as a cavity located within the handle comprising an opening located at the second end of the handle. The attachment feature located at the first end of the detachable member.

13 Claims, 5 Drawing Sheets

(56) References Cited

U.S. PATENT DOCUMENTS

| | | | | |
|---|---|---|---|---|
| 7,318,610 | B2 * | 1/2008 | Nelson | B25J 1/04 294/902 |
| 7,344,171 | B1 * | 3/2008 | McMullan | E01H 1/1206 294/902 |
| 9,469,951 | B1 * | 10/2016 | Qi | B25G 1/04 |
| 10,076,171 | B2 | 9/2018 | Spann Myers | |
| 2003/0020293 | A1 * | 1/2003 | Hsu | B25G 3/18 294/210 |
| 2004/0134509 | A1 | 7/2004 | Belton | |
| 2009/0071492 | A1 * | 3/2009 | Oh | A41G 5/006 132/201 |
| 2010/0021279 | A1 * | 1/2010 | Buzby | B25J 1/04 414/800 |
| 2014/0042760 | A1 * | 2/2014 | Yu | B25B 9/00 294/111 |
| 2014/0216110 | A1 * | 8/2014 | Smelcer | D04B 3/02 66/118 |
| 2015/0374372 | A1 * | 12/2015 | Zergiebel | A61B 17/068 227/180.1 |
| 2018/0055185 | A1 | 3/2018 | Spann-Myers | |

* cited by examiner

HAIR CROCHET APPARATUSES AND METHODS

CROSS-REFERENCE TO RELATED APPLICATIONS

This application contains subject matter related to and claims the benefit of U.S. Provisional Patent Application No. 62/883,586, filed Aug. 6, 2019, the entire contests of which is incorporated herein by reference.

FIELD OF THE TECHNOLOGY

The present disclosure relates to apparatuses and methods for crocheting hair.

BACKGROUND

Aspects of the present application relates to the field of hairstyling. More particularly, it relates to a tool used to stitch extensions or other ornamental decorative items through hair. In the hairdressing field, there have been many different types of devices designed to make the hair look more attractive or decorative. Some of these devices involve needles, clips or comb-like devices which can be used to style the hair in many decorative fashions.

Related art hair crocheting tools are based on latch-hook tools used to hand make rugs or for knitting. In knitting, a latch needle is a knitting machine that wraps yarn around the latch and pushed the yarn through a canvas before pulling it through, thereby knotting the yarn to the canvas. As a result, the latch and the hook of these conventional tools are large, thick, and bulky.

Similar techniques and tools are used in related art hairstyling, where hair extensions are looped under a cornrow hair braid and woven into the braid. However, unlike crocheting rugs, the braids are attached to the scalp. Therefore, using conventional tools provide numerous difficulties. For example, inserting the tool under the cornrow braid, for example, requires considerable force and finesse to overcome the tension of the tightly braided hair without damaging and or pulling out the hair.

As it will be appreciated, damage or loss of hair may be a painful or undesirable experience. It will be further appreciated that hairstylists must perform the same repetitive process hundreds of times a day, causing calluses or other muscle injuries of the stylist's hands, arms, or spine. Further, conventional tools require that, for example, the latch of the latch-hook device be manually opened or closed. Due to the size of the latch, this is often done by the stylist using their fingernail. This frequently leads to the painful experience of having the latch becoming stuck under the fingernail and causing bleeding. Therefore, it would be advantageous to have a tool that is slender, and will reduce the likelihood of such injuries by reducing the physical strain placed in the stylist.

Aspects of the present disclosure address these and other disadvantages exist.

SUMMARY

Disclosed examples provide an apparatus and methods for an apparatus for crocheting hair. Consistent with the disclosed examples, an apparatus is disclosed. In an example, the apparatus can include a handle including a first end, a second end, a connection receptacle configured to receive a connection feature of a detachable member, an attachment receptacle located at the first end of the handle and configured to receive an attachment feature of the detachable member; and a cavity located within the handle, the cavity comprising an opening located at the second end of the handle, and wherein the cavity is can be dimensioned to store one or more detachable members.

Consistent with the disclosed examples, a method is disclosed. In a method for constructing the apparatus includes attaching, at a first end of a handle, an attachment receptacle configured to receive an attachment feature; attaching, proximate to the attachment receptacle, a connection receptacle configured to receive a connection feature. The method further includes attaching, at a second end of the detachable member, an attachment feature configured to insert into the attachment receptacle and attaching, at the second end of the detachable member, a connection feature configured to insert into the connection receptacle.

Consistent with the disclosed examples, a method for using the apparatus is disclosed. In an example, the apparatus can have a handle comprising a first end, a second end, an attachment receptacle, a connection receptacle, and a cavity. The cavity can be dimensioned to store one or more detachable members. The apparatus can further include an enclosure that covers an opening of the cavity, and a multi-function feature attached to the handle, the multi-function feature comprising a motion-transformer. The apparatus can further still include a first cable section adjustably connected to the motion-transformer and attached to the connection receptacle, and a first detachable member of the one or more detachable members, the first detachable member comprising a first end, a second cable section, a connection feature, and an attachment feature located at the first end of the first detachable member. The cavity is located within the handle, the cavity further comprises the opening located at the second end of the handle. The attachment receptacle is located at the first end of the handle and configured to receive the attachment feature of the detachable member. The connection receptacle is located within or proximate to the attachment receptacle and configured to receive the connection feature of the detachable member. The first cable section and the second cable section are connected via a connection of the connection feature to the connection receptacle. The first detachable member is secured to the handle via a connection of the attachment feature to the attachment receptacle.

Consistent with the disclosed examples, an apparatus is disclosed. In an example, the apparatus can have a handle including a first end, a second end, and a cavity located within the handle having an opening disposed on the second end of the handle, and an attachment receptacle disposed on the first end of the handle.

Further features of the disclosed design, and the advantages offered thereby, are explained in greater detail hereinafter with reference to specific examples illustrated in the accompanying drawings, wherein like elements are indicated be like reference designators.

BRIEF DESCRIPTION OF THE DRAWINGS

Reference will now be made to the accompanying drawings, which are not necessarily drawn to scale, and which are incorporated into and constitute a portion of this disclosure, illustrate various implementations and aspects of the disclosed technology and, together with the description, serve to explain the principles of the disclosed technology. In the drawings.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION

Figure 1:
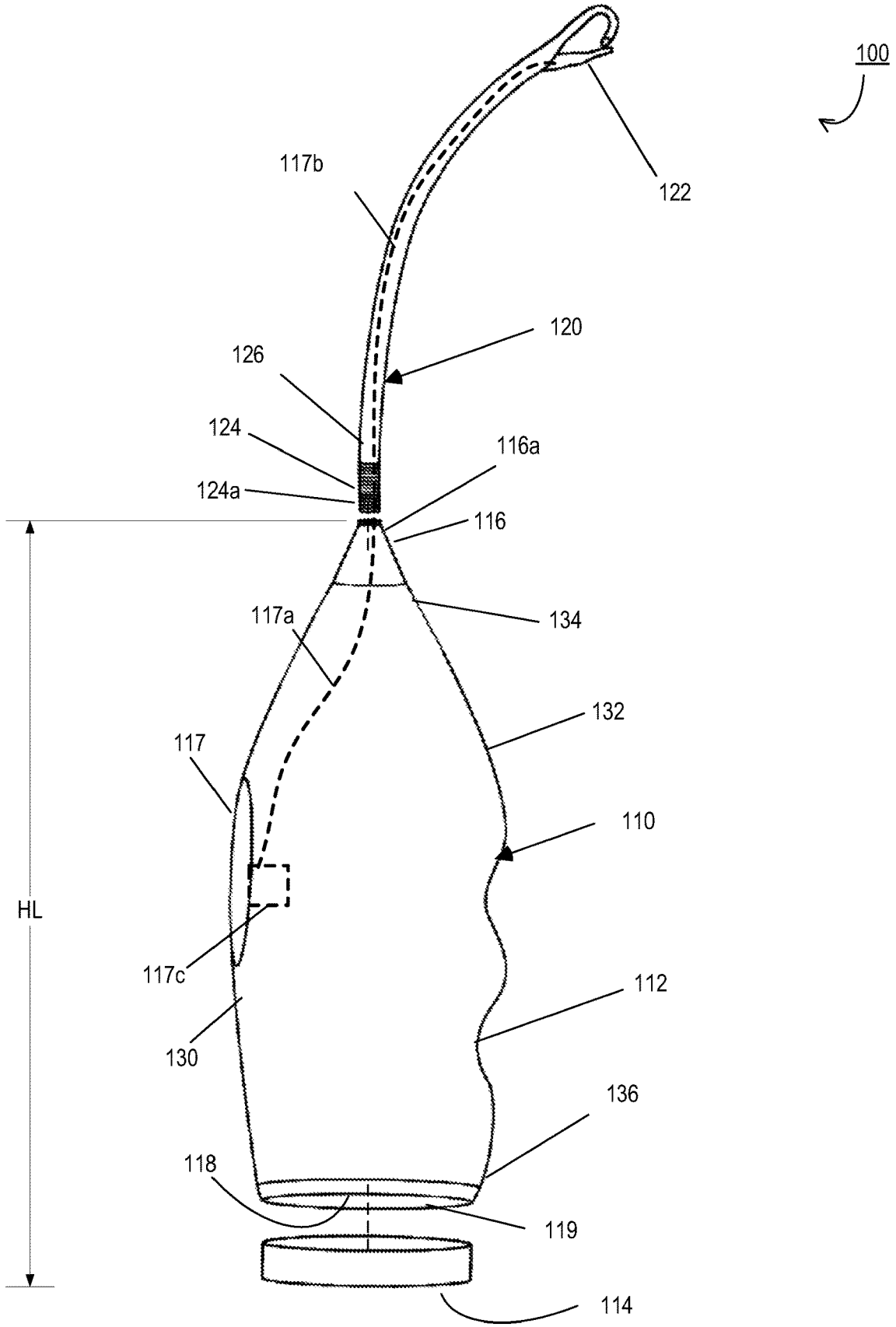
FIG. 1 illustrates an example apparatus, according to an example of the disclosure.

Some implementations of the disclosed technology will be described more fully with reference to the accompanying drawings. This disclosed technology may, however, be embodied in many different forms and should not be construed as limited to the implementations set forth herein. The components described hereinafter as making up various elements of the disclosed technology are intended to be illustrative and not restrictive. Many suitable components that would perform the same or similar functions as components described herein are intended to be embraced within the scope of the disclosed electronic devices and methods. Such other components not described herein may include, but are not limited to, for example, components developed after development of the disclosed technology.

It is also to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

As discussed above, related art tools for crocheting hair extensions onto cornrow braids are designed for crocheting rugs or scarves and, accordingly, are not well suited for crocheting hair extensions on to a person's scalp. Thus, injuries to the stylist and even the customer receiving the hair extensions can and do occur. Accordingly, aspects of the present disclosure reduce the risk of injuries to the stylist and the customer, as well as provide utility designed for hair crocheting.

In an example, a crocheting tool (i.e. device) can have a handle with a cavity to store detachable parts that can attach to the handle. The detachable parts (i.e. detachable members) can include needles, for example, a J-needle or a S-needle, for crocheting hair. The detachable parts can also include a pair of shears for cutting hair. Additionally, the tool can also have a multi-function feature that can, upon actuation, manipulate the attachments (i.e. detachable members) by utilizing a first and second cable section, connection features and connection receptacles, and a motion transformer configured to enable the manipulation of the attachment, for example, by pressing or otherwise actuating the multi-function feature a latch located on the detachable part can be manipulated. The cable connection can occur at the connection feature of the detachable part and the connection receptacle of the handle. By having the stylist use the multi-function feature to manipulate sharp parts like a latch, the tool helps the stylist avoid injuring their fingers. The bend in the J-needle provides extra clearance for the stylist to push the needle under the low-tension cornrow braids in the middle and back of the head. The extra clearance allows the stylist to easily crochet extension without damaging the customer's hair. Similarly, the S-needle provides extra control and stability when pushing the S-needle under the high-tension cornrow braids at the front of the head.

The tool can be used by attaching a detachable part to the handle. This can include attaching the physical detachable part and/or the connection feature of the detachable part (i.e., to enable manipulation using the multi-function feature). Additionally or alternatively, portions of the detachable part can be manipulated by the multi-function feature located on the handle. Additionally or alternatively, portions of the detachable part can be manipulated without the multi-function feature. Once the use of the detachable part is complete, the detachable part can be detached from the handle. Detachment from the handle includes detaching the connection feature from the connection receptacle and/or detaching the attachment feature from the attachment receptacle. The detachable part can then be placed into a cavity within the handle. An enclosure can be applied to the cavity to keep the detachable part within the cavity.

Reference will now be made in detail to examples of the disclosed technology, examples of which are illustrated in the accompanying drawings and disclosed herein. Wherever convenient, the same references numbers will be used throughout the drawings to refer to the same or like parts.

FIG. 1 is an illustration of an example of an apparatus 100 for crocheting hair. The components and arrangements shown in FIG. 1 are not intended to limit the disclosed examples as the components used to implement the disclosed processes and features may vary. The apparatus 100 includes a handle 110 and a detachable member 120. The handle 110, can further include a first end 134, a second end 136, a grip feature 112 disposed on a ventral surface 132 (i.e., a ventral side), an enclosure 114 that encloses a cavity opening 119 of the cavity 118 found within the handle 110. The cavity 118 can be dimensioned to store one or more detachable members 120. The handle 110 can also include an attachment receptacle 116, the attachment receptacle 116 configured to receive an attachment feature 124 of the detachable member 120, a multi-function feature 117 disposed on a dorsal surface 130 (i.e., a dorsal side) of the handle 110. The detachable member 120 includes the attachment feature 124, a first end 122 and a second end 126.

The handle 110 can be constructed out of one or several materials. The materials can include, for example, one or more of: aluminum, stainless steel, wood, bamboo, foam, cellulose fibers, PVC, PET, rubber, ceramic, terra cotta, phosphorescent materials, stones, gel or aerogel. It is further understood that the handle 110 or portions of the handle 110 can include surface finishes or coatings, for example, but are not limited to: waterproofing coatings, sealants, anti-corrosion coatings, anti-reflective coatings, insulating coatings, conformal coatings, anti-scratch coatings, magnetic coatings, anti-fouling coatings, fragrance coatings, anti-friction coatings, fire protective coatings, tints or reflective coatings. The handle 110 can have a generally cylindrical or rectangular shape. A handle length HL, denotes a dimension from the first end 134 of the handle 110 to the second end 136 of the handle 110.

The grip feature 112 can include grooves or contours that can be disposed on the ventral surface 132 of the handle 110. It would be understood by one of skill in the art that the grip feature 112 can also be disposed on other locations of the handle 110, for example, the dorsal surface 130. The grip feature 112, can also be high friction material or any compliant material that changes shape in response to pressure to conform around the shape of the pressure-applying article, attached to the handle 110. It is further understood that the grip feature 112 can also include features, for example, ribs, ridges, perforations, slots, holes, baffles, threads, decals, tapers, engravings, stamps, reliefs, dimples, or indentations.

The enclosure 114, can be connected to or not connected to the handle 110. The enclosure 114 can be a cap, a lid, or a plug that covers or closes the cavity opening 119 of the cavity 118. The enclosure 114 can be detachably fastened to the handle 110, the cavity 118, or the cavity opening 119.

The attachment receptacle 116, can be attached to the first end 134 of the handle 110. It will be understood that the attachment receptacle 116 can also be attached to other locations on the handle 110, for example, the dorsal surface 130. It will also be understood that the attachment receptacle 116 can include, for example, one or more of: pins, nuts, pegs, latches, keys, screws, threaded fasteners, snap fasteners, hook and loop fasteners, magnets, clips, slots or clamps. The attachment receptacle 116 can be configured to receive one or more attachment features 124 and secure the detachable member 120 to the handle 110.

In an example, the attachment receptacle 116 can also provide a means by which to connect the multi-function feature 117 to the detachable member 120 for example, a first cable section 117*a* can run from the multi-function feature 117 to the attachment receptacle 116 and the first cable section 117*a* can, upon insertion of the attachment feature 124, a connection can be formed between the first cable section 117*a* terminating at the attachment receptacle 116 utilizing connection receptacle 116*a* and the second cable section 117*b* of the detachable member 120 terminating at the attachment feature 124 using connection feature 124*a*. In examples, the connection feature 124*a* can be incorporated into attachment feature 124. This connection can provide a means by which activating the multi-function feature 117 manipulates the detachable member 120. The connection receptacle 116*a* configured to receive the connection feature 124*a*. In examples, the first cable section 117*a* and the second cable section 117*b* can entirely or partially pass within the handle 110 or the detachable member 120. In other examples, the first cable section 117*a* and the second cable section 117*b* can entirely or partially pass outside the handle 110 or the detachable member 120. It will be understood that the first cable section 117*a* and the second cable section 117*b* can be a bar linkage, spring, steel wire, steel cable or their polymer/plastic counterparts. In an example, activating the multi-function feature 117 manipulates the first cable section 117*a* and the second cable section 117*b* in a proximal direction. In another example, activating the multi-function feature 117 manipulates the first cable section 117*a* and the second cable section 117*b* in a distal direction. It will be appreciated that manipulating the first cable section 117*a* and the second cable section 117*b* in a distal direction need not require the first cable section 117*a* to connect through the connection receptacle 116*a* and the connection feature 124*a* to the second cable section 117*b*. For example, the first cable section 117*a* can be manipulated by the activation of the multi-function feature 117 to move in a distal direction and push against the second cable section 117*b* thereby manipulating the second cable section 117*b*. Upon deactivating the multi-function feature 117, the first cable section 117*a* can return to back to its resting state allowing the second cable section 117*b* to also return to its resting state. Here, the resting state of the first cable section 117*a* describes a configuration of the first cable section 117*a* when the multi-function feature 117 is not activated. Similarly, the resting state of the second cable section 117*b* describes a configuration of the second cable section 117*b* when the multi-function feature 117 is not activated.

The cavity 118 can be within the handle 110. The cavity 118 can have a cavity opening 119 that is located at the second end 136 of the handle 110. It would be understood by one of skill in the art that the cavity opening 119 can be located elsewhere on the handle 110, for example, the ventral surface 132. The cavity 118 can also be dimensioned to store one or more detachable members 120.

The multi-function feature 117 can include a button, slider, key, lever or wheel for activating the multi-function feature 117 and can be attached to, for example, the first cable section 117*a*. The first cable section 117*a* can be connected to the detachable member 120 through the connection receptacle 116*a* of the attachment receptacle 116 and the connection feature 124*a* the attachment feature 124. Manipulation of the multi-function feature 117, in this manner, can move, for example, features associated with the detachable member 120 disclosed at least in FIG. 2A-2B, and FIG. 3. In examples, the multi-function feature 117 need not attach to a first cable section 117*a*. In yet another example, the multi-function feature 117 can display a logo and can be constructed out of one or more materials, for example, aluminum, stainless steel, wood, bamboo, foam, cellulose fibers, PVC, PET, rubber, ceramic, terra cotta, phosphorescent materials, stones, gel or aerogel. In still yet another example, the multi-function feature 117 can include a motion-transformer 117*c* that converts motion along an axis to a motion along another axis. The multi-function feature 117 can also include a lock that is configured to keep the multi-function feature in an activated or deactivated configuration without persistent user intervention.

The motion-transformer 117*c* can also employ mechanical advantage machines, for example, gears, levers, pulleys, or the like. In an example, these machines can be electrically energized. In other examples, sliding the elements associated with the detachment member 120, a certain distance can require a smaller (or larger) distance to be traveled by the multi-function feature 117 such that more (or less) force is required by the user to manipulate the multi-function feature 117. The mechanical advantage delivered by the motion-transformer 117*c* can be adjustable or configurable by the user. In some examples, the first cable section 117*a* can be adjustably connected to the motion-transformer 117*c*. In other examples, the first cable section 117*a* can be adjustably connected to the multi-function feature 117.

The detachable member 120 can have a first end 122 and a second end 126. The detachable member 120 can include an attachment feature 124 located at the second end 126 of the detachable member 120.

The attachment feature 124 can be located at the second end 126 of the detachable member 120. It will be appreciated by one of skill in the art in light of the present disclosure that the attachment feature 124 can be located, for example, on the first end 122 of the detachable member 120. It will also be understood that the attachment feature 124 can include, for example, one or more of: pins, nuts, pegs, latches, keys, screws, threaded fasteners, snap fasteners, hook and loop fasteners, magnets, clips, slots or clamps. The attachment feature 124 can be configured to be inserted into the attachment receptacle 116. The attachment feature 124 can also provide a means by which to connect the multi-function feature 117 to the detachable member 120, for example, the first cable section 117*a* can run from the multi-function feature 117 to the attachment receptacle 116 and the first cable section 117*a* can, upon insertion of the attachment feature 124, a connection can be formed between the first cable section 117*a* terminating at the attachment receptacle 116 utilizing connection receptacle 116*a* and the second cable section 117*b* of the detachable member 120 terminating at the attachment feature 124 using connection feature 124*a*. This connection can provide a means by which activating the multi-function feature 117 can manipulate the detachable member 120. The connection receptacle 116*a* configured to receive the connection feature 124*a* forming a connection between the first cable section 117*a* and the second cable section 117*b*.

Figure 2A:
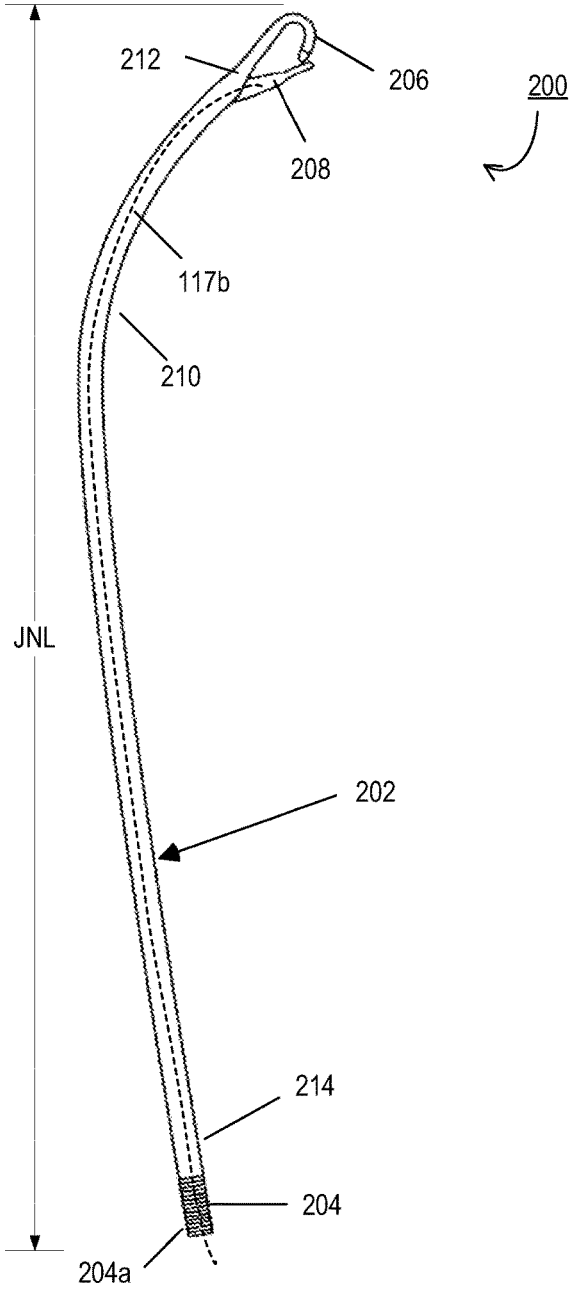
FIGS. 2A-B illustrate examples of detachable members according to aspects of the present disclosure.
Figure 2B:
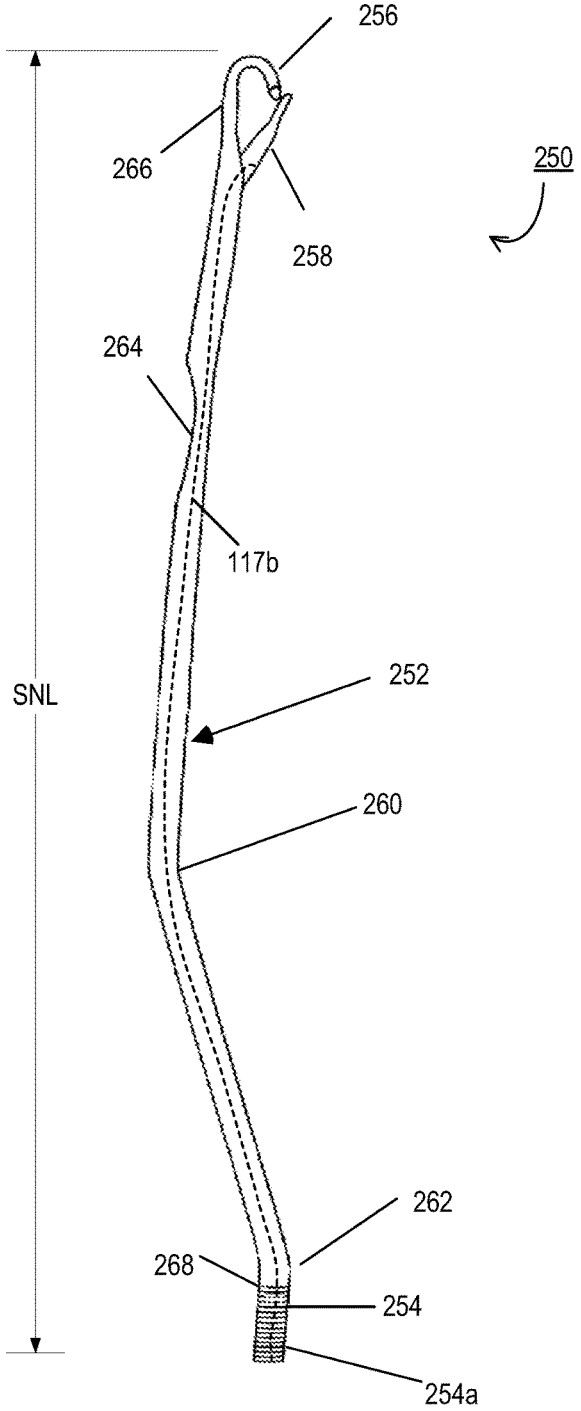

FIG. 2A illustrate an example of a detachable member 200 according to aspects of the present disclosure. The components and arrangements shown in FIG. 2B are not intended to limit the disclosed examples as the components used to implement the disclosed processes and features may vary. In accordance with disclosed examples, a J-needle detachable member 200 can include a J-needle 202 having a first end 212, a second end 214, and a bend 210. The J-needle 202 can further include a hook 206 disposed on the first end 212, and a latch 208 disposed on the first end 212. The bend 210 can be located on the J-needle 202. A length of the J-needle, JNL, represents a dimension between the first end 212 of the J-needle 202 and the attachment feature 204. The length of the J-Needle, JNL, can be less than the length HL. In other examples, the length of the J-Needle, JNL, can be configured to be less than the handle length HL via means for telescoping or means for folding the J-Needle.

The J-needle 202 can be hollow, providing accommodation for, as an example, a second cable section 117*b* to run from the attachment feature 204 the latch 208. Additionally, the J-needle 202 can be hollow to accommodate the latch 208 which can be retracted using the multi-function feature 117 via the first cable section 117*a* and motion-transformer 117*c*. It would be appreciated to one of skill in the art that the J-needle 202 can be constructed out of one material or several materials. The materials can include, for example, one or more of: aluminum, steel, stainless steel, iron, wood, bamboo, foam, cellulose fibers, PVC, PET, glass, acrylic, or ceramics.

The attachment feature 204 can be located at the second end 126 of the detachable member 120. It will be appreciated by one of skill in the art in light of the present disclosure that the attachment feature 204 can be located, for example, on the first end 212 of the J-needle 202. It will also be understood that the attachment feature 204 can include, for example, one or more of: pins, nuts, pegs, latches, keys, screws, threaded fasteners, snap fasteners, hook and loop fasteners, magnets, clips, slots or clamps. The attachment feature 204 can be configured to be inserted into the attachment receptacle 116 and secure the J-needle 202 to the handle 110. The attachment feature 204 can also provide a means by which to connect the multi-function feature 117 to the latch 208, for example, the first cable section 117*a* can run from the multi-function feature 117 to the a connection receptacle 116*a* which can be located proximate or within the attachment receptacle 116 and the first cable section 117*a*, upon insertion of the attachment feature 204, can connect the first cable section 117*a* terminating at the connection receptacle 116*a* and the second cable section 117*b* of the detachable member 120 terminating at the connection feature 204*a* located proximate or within the attachment feature 204. In examples, the connection feature 204*a* can be incorporated into attachment feature 204. This connection can provide a means by which triggering the multi-function feature 117 manipulates the latch 208. The connection receptacle 116*a* configured to receive the connection feature 204*a* forming a connection between the first cable section 117*a* and the second cable section 117*b*.

The bend 210 in the J-needle 202 allows for the stylist to cantilever the J-needle 202 into the low-tension hair located at the behind the front of the cornrow braids and provides extra clearance for the stylist's fingers.

The hook 206 can be disposed on the first end 212 of the J-needle 202. The hook 206 is used to pull hair to be crocheted under the cornrow braid. In examples, the hook 206 can be attached to the multi-function feature 117 via the first cable section 117*a* and the second cable section 117*b* in place of the latch 208 disclosed above. In other examples, both the hook 206 and the latch 208 can be attached to the multi-function feature 117 via the first cable section 117*a* and the second cable section 117*b*.

The latch 208 can be disposed proximate to the hook 206. The latch 208 can have a first configuration and a second configuration. The latch 208, in the first configuration, is in contact with the hook 206. The latch 208, in the second configuration, is not in contact with the hook 206. In an example, the latch 208 can be moved from one configuration to the other either manually. In another example, the latch 208 can be moved from one configuration by means of the multi-function feature 117 and the first cable section 117*a* and the second cable section 117*b* as discussed supra.

FIG. 2B illustrate an example of a detachable member 250 according to aspects of the present disclosure. The components and arrangements shown in FIG. 2B are not intended to limit the disclosed examples as the components used to implement the disclosed processes and features may vary. In accordance with disclosed examples, an S-needle detachable member 250 can include an S-needle 252 having a first end 266, a second end 268, a first bend 260 and a second bend 262. The S-needle 252 can further include a hook 256 disposed on the first end 266, and a latch 258 disposed on the first end 266. The first bend 260 and the second bend 262 can be located on the S-needle 252. A length of the S-needle, SNL, represents a dimension between the first end 266 of the S-needle 252 and the attachment feature 254. The length of the S-Needle, SNL, can be less than the handle length HL. In other examples, the length of the S-Needle, SNL, can be configured to be less than the handle length HL via means for telescoping or means for folding the S-Needle.

The S-needle 252 can be hollow, providing accommodation for, as an example, the second cable section 117*b* to run from the attachment feature 254 the latch 258. Additionally, the S-needle 252 can accommodate the latch 258 which can be retracted using the multi-function feature 117, via the first cable section 117*a*, the second cable section 117*b*, and motion-transformer 117*c*. It would be appreciated to one of skill in the art that the S-needle 252 can be constructed out of one material or several materials. The materials can include, for example, one or more of: aluminum, steel, stainless steel, iron, wood, bamboo, foam, cellulose fibers, PVC, PET, glass, acrylic, or ceramics.

The attachment feature 254 can be located at the second end 126 of the detachable member 120. It would be appreciated by one of skill in the art that the attachment feature 254 can be located, for example, on the first end 266 of the S-needle 252. It will also be understood that the attachment feature 254 can include, for example, one or more of: pins, nuts, pegs, latches, keys, screws, threaded fasteners, snap fasteners, hook and loop fasteners, magnets, clips, slots or clamps. The attachment feature 254 can be configured to be inserted into the attachment receptacle 116 and secure the S-needle 252 to the handle 110. The attachment feature 254 can also provide a means by which to connect the multi-function feature 117 to the latch 258, for example, the first cable section 117*a* can run from the multi-function feature 117 to the attachment receptacle 116 and the first cable section 117*a*, upon insertion of the attachment feature 254, can connect the first cable section 117*a* terminating at the connection receptacle 116*a* which can be located within or proximate to the attachment receptacle 116 and the second cable section 117*b* of the detachable member 120 terminating at the connection feature 254*a* which can be located proximate or within the attachment feature 254. In examples, the connection feature 254*a* can be incorporated into attachment feature 254. This connection can provide a means by which triggering the multi-function feature 117 manipulates the latch 258. The connection receptacle 116*a* configured to receive the connection feature 254*a* forming a connection between the first cable section 117*a* and the second cable section 117*b*.

The first bend 260 and the second bend 262 in the S-needle 252 allows for extra clearance of the stylist's fingers when inserting the S-needle detachable member 250 into the high-tension hair located at the front of the cornrow braids.

The hook 256 can be disposed on the first end of the S-needle 252. The hook 256 is used to pull hair to be crocheted under the cornrow braid. In examples, the hook 256 can be attached to the multi-function feature 117 via the first cable section 117*a*, the second cable section 117*b* and the motion-transformer 117*c* in place of the latch 258 disclosed above. In other examples, both the hook 256 and the latch 258 can be attached to the multi-function feature 117 via the first cable section 117*a*, the second cable section 117*b*, and the motion-transformer 117*c*.

The latch 258 can be disposed proximate to the hook 256. The latch 258 can have a first configuration and a second configuration. The latch 258, in the first configuration, is in contact with the hook 256. The latch 258, in the second configuration, is not in contact with the hook 256. The latch 258 can be moved from one configuration to the other either manually, or by means of the multi-function feature 117 as discussed above with reference to FIG. 2A.

Figure 3:
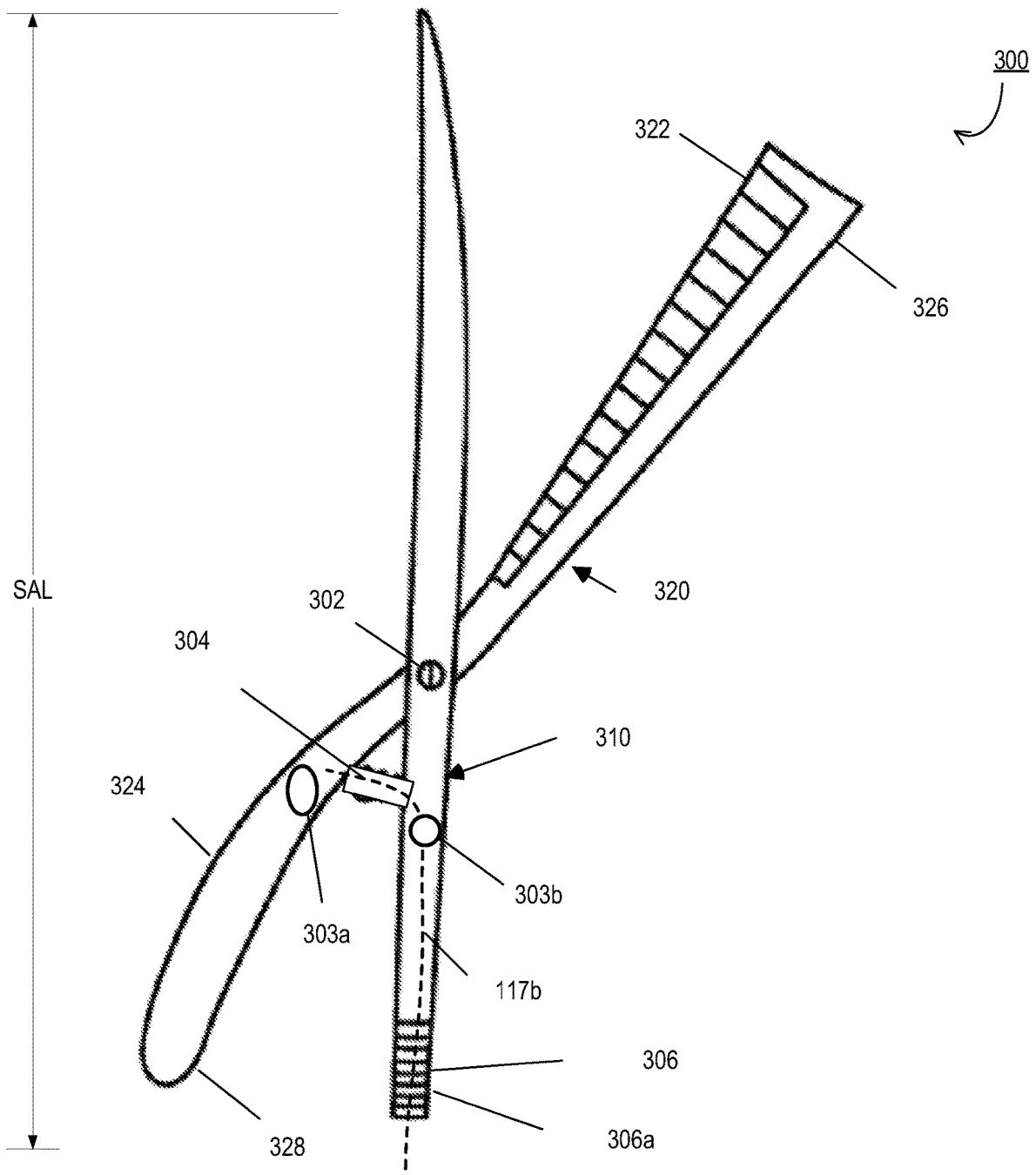
FIG. 3 illustrates another example of a detachable member according to aspects of the present disclosure.

FIG. 3 illustrates another example of a detachable member 300 according to aspects of the present disclosure. The components and arrangements shown in FIG. 3 are not intended to limit the disclosed examples as the components used to implement the disclosed processes and features may vary. In accordance with disclosed examples, the shearing attachment detachable member 300 can include an upper shear 310, a lower shear 320, a connection feature 306*a* and an attachment feature 306. The upper shear 310 and the lower shear 320 are coupled together using a pivot point 302. The pivot point 302 can be a fastener, for example, one or more of: pins, nuts, pegs, latches, keys, screws, threaded fasteners, snap fasteners, hook and loop fasteners, magnets, clips or clamps. The upper shear 310 and lower shear 320 can be kept open (i.e., not parallel with respect to one another) by a uniaxial member 304. In another example, the uniaxial member 304 can keep the upper shear 310 and the lower shear 320 closed (i.e., parallel with respect to one another). In another example, the uniaxial member 304 can restore the upper shear 310 and the lower shear 320 to a closed configuration (i.e., parallel with respect to one another). In another example, the upper shear 310 and lower shear 320 can be restored to an open configuration (i.e., not parallel with respect to one another) by a uniaxial member 304. The second cable section 117*b* can connect the upper shear 310 to the connection feature 306*a*. The first cable section 117*a* can connect the multi-function feature 117 to the connection receptacle 116*a*, and the motion-transformer 117*c*. A length of the shearing attachment detachable member 300, SAL, represents a dimension between the first end 326 of the lower shear 320 and the attachment feature 306. The length of the shearing attachment detachable member, SAL, can be less than the handle length HL. In other examples, the length of the shearing attachment detachable member, SAL, can be configured to be less than the handle length HL via means for telescoping or means for folding the shearing attachment.

It would be appreciated to one of skill in the art that the upper shear 310 and the lower shear 320 can be constructed out of one material or several materials. The materials can include, for example, one or more of: aluminum, steel, stainless steel, iron, wood, bamboo, foam, cellulose fibers, PVC, PET, glass, acrylic, or ceramic.

The attachment feature 306 can be disposed on upper shear 310 and configurable to be inserted into the attachment receptacle 116 and secure the detachable member 300 to the handle 110.

The lower shear 320, having a first end 326, a second end 328, a thumb shank 324 and a cutting edge 322. The cutting edge 322 can be disposed on the first end 326 of the lower shear 320, and the thumb shank 324 can be disposed on the second end 328 of the lower shear 320.

In an example, the thumb shank 324 can be manually actuated by the stylist pressing their finger on the thumb shank 324 causing the lower shear 320 to become parallel to the upper shear 310 by rotating about the pivot point 302. In this example, the uniaxial member 304 will automatically reconfigure the upper shear 310 and the lower shear 320 into a non-parallel configuration about the pivot point 302.

In an example, the thumb shank 324 can be actuated by, for example, the multi-function feature 117. The multi-function feature 117 can actuate the thumb shank 324 via, for example, a connection of the first cable section 117*a* to the second cable section 117*b* using the connection feature 306*a* which can be located within or proximate to attachment feature 306, connection receptacle 116*a* which can be disposed proximate or within the attachment receptacle 116, and the motion-transformer 117*c* in communication with the multi-function feature 117 causing the upper shear 310 and the lower shear 320 to toggle between parallel and non-parallel configurations about the pivot point 302. The connection receptacle 116*a* can be configured to receive the connection feature 306*a* forming a connection between the first cable section 117*a* and the second cable section 117*b*. In this example, the uniaxial member 304 can guide or assist the second cable section 117*b* from the connection feature 306*a* to the thumb shank 324. The engagement and disengagement of the multi-function feature 117 can manipulate the upper shear 310 and lower shear 320 between the parallel and non-parallel configurations In still yet another example, there can be a plurality of uniaxial member 304, having discreet functions. For example, a first uniaxial member can be a coil or a spring to return the upper shear 310 and the lower shear 320 to a non-parallel configuration while a second uniaxial member can assist or guide the second cable section 117*b* to the connection feature 306*a* as described above to facilitate the manipulation of the upper shear 310 and lower shear 320 between the parallel and non-parallel configurations described above.

In even yet another example, there can be a plurality of uniaxial member 304, having discreet functions. For example, a first uniaxial member can be a coil or a spring to return the upper shear 310 and the lower shear 320 to a parallel configuration while a second uniaxial member can assist or guide the second cable section 117*b* to the connection feature 306*a* as described above to facilitate the manipulation of the upper shear 310 and lower shear 320 between the parallel and non-parallel configurations described above.

A lock feature 303*a* is configured to be secured to lock receptacle 303*b*. The lock feature 303*a* can be disposed on either the upper shear 310 or the lower shear 320. Upon engaging the lock feature 303*a* upon the lock receptacle 303*b*, the upper shear 310 and lower shear 320 maintain a parallel configuration until the lock feature 303*a* is disengaged from the lock receptacle 303*b*. The lock feature 303*a* can be a lock, latch or toggle, for example, one or more of: a magnetic lock, locking bar, hasps, draw latch, push-to-close latch, swinging latch, cam locks, toggle clamps or flush bolt lock.

The lock receptacle 303*b* can be disposed on either the upper shear 310 or lower shear 320 and configured to receive the lock feature 303*a*. The lock receptacle 303*b* can be a lock or a latch, for example, one or more of: a magnetic lock, locking bar, hasps, draw latch, push-to-close latch, swinging latch, cam locks, or flush bolt lock.

The cutting edge 322 can be disposed on the first end 326 of the lower shear 320. The cutting edge 322 can be a sharp straight edge that will cut hair strands or can have teeth that can selectively cut hair strands.

Figure 4:
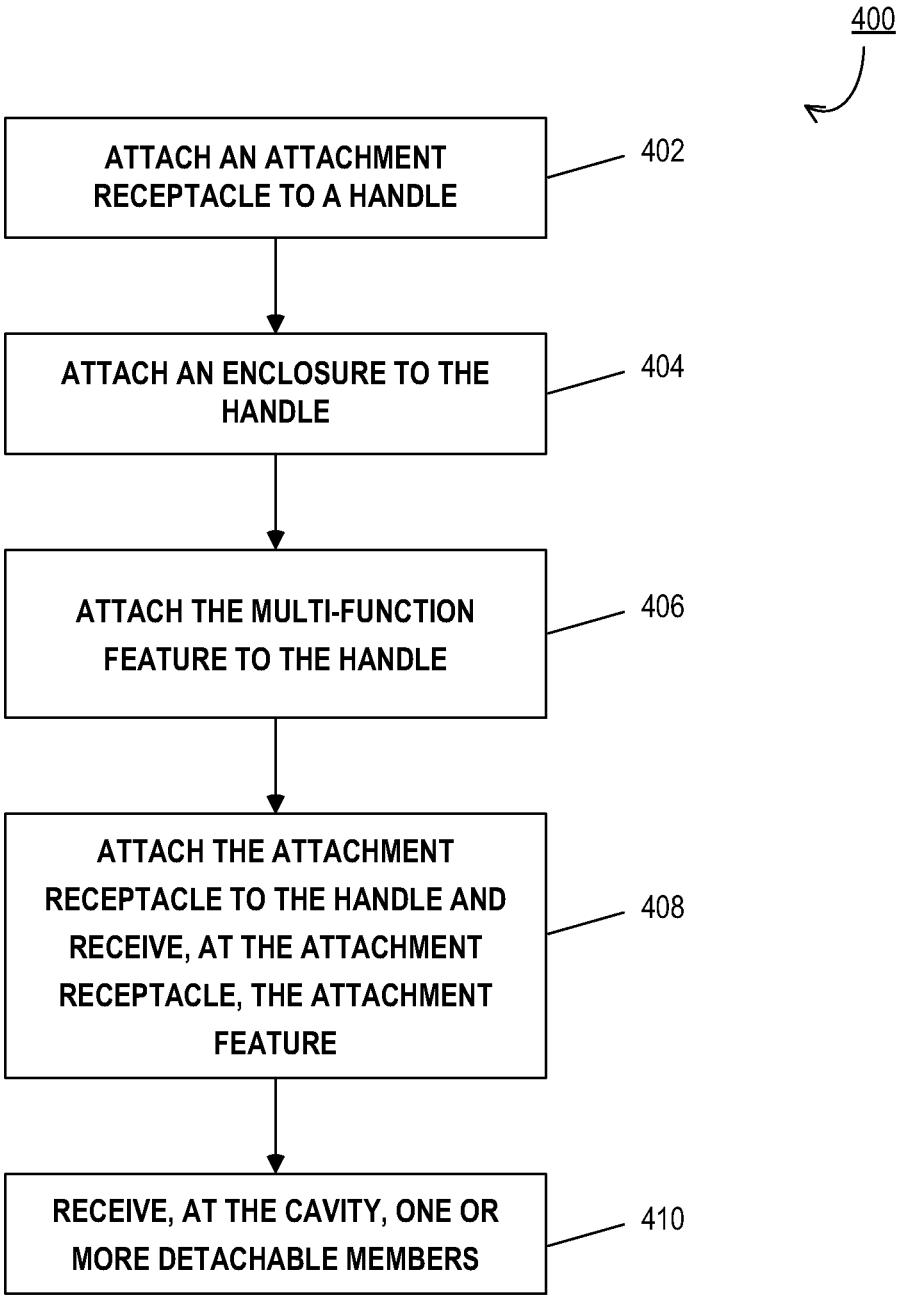
FIG. 4 is a flowchart of a method of assembling an apparatus for crocheting hair according to an example.

FIG. 4 illustrates a flowchart of a method 400 of assembling an apparatus 100 for crocheting hair according to an example.

At block 402, the attachment receptacle 116 can be attached to the first end 134 of the handle 110. Additionally, a connection receptacle 116*a* can be attached to the handle 110. In an example, the connection receptacle 116*a* can be integral to the attachment receptacle 116. Alternatively, in an example, the connection receptacle 116*a* can be distinct from (e.g., not integrated with) the attachment receptacle 116. The connection receptacle 116*a* being attached to the first cable section 117*a* and configured to receive the connection feature 124*a* forming a connection between the first cable section 117*a* and the second cable section 117*b*. The method can proceed to block 404.

At block 404, the handle 110 having a cavity 118 and a cavity opening 119 disposed on the second end 136 of the handle 110, can receive an enclosure 114. The enclosure 114, can detachably attach to the second end 136 of the handle 110. In examples, the enclosure 114 can be attached to the second end 136 of the handle 110, and can be configured to cover the cavity opening 119 by means of twisting or snapping into a closed configuration. The method can proceed to block 406.

At block 406, the multi-function feature 117 can be attached to the handle 110. The motion-transformer 117*c* can be attached to the multi-function feature 117. In an example, the motion-transformer 117*c* can be attached to the handle 110. In examples, the motion-transformer 117*c* can be positioned within the cavity 118. In other examples, the motion-transformer 117*c* can be positioned on the dorsal surface 130 of the handle 110. The first cable section 117*a* can be adjustably attached to the motion-transformer 117*c*. The multi-function feature 117 can feature a locking mechanism to hold the multi-function feature 117 in an activated configuration. The multi-function feature 117 can feature a locking mechanism to hold the multi-function feature 117 in a deactivated configuration. The method can proceed to block 408.

At block 408, the attachment receptacle 116, configured to receive the attachment feature 124, can receive the attachment feature 124 of the detachable member 120 and secure the detachable member 120 to the handle 110. Once received, the detachable member 120 is secured to the handle 110. Further, the connection receptacle 116*a*, configured to receive the connection feature 124*a*, can receive the connection feature 124*a* of the detachable member 120. The connection receptacle 116*a* can be further configured to connect to the first cable section 117*a*, which is in turn, can be adjustably connected to the motion-transformer 117*c*. The connection feature 124*a* can be further configured to connect to the second cable section 117*b*. Once the connection receptacle 116*a* receives connection feature 124*a*, the connection between the first cable section 117*a* and the second cable section 117*b* is secured allowing the multi-function feature 117 to manipulate the second cable section 117*b*, and by extension, any feature or features attached to the second cable section 117*b*. The method can proceed to block 410.

At block 410, the cavity 118, dimensioned to store one or more detachable members 120, can receive the one or more detachable members 120. The enclosure 114 can then be detachably attached to the cavity opening 119.

Figure 5:
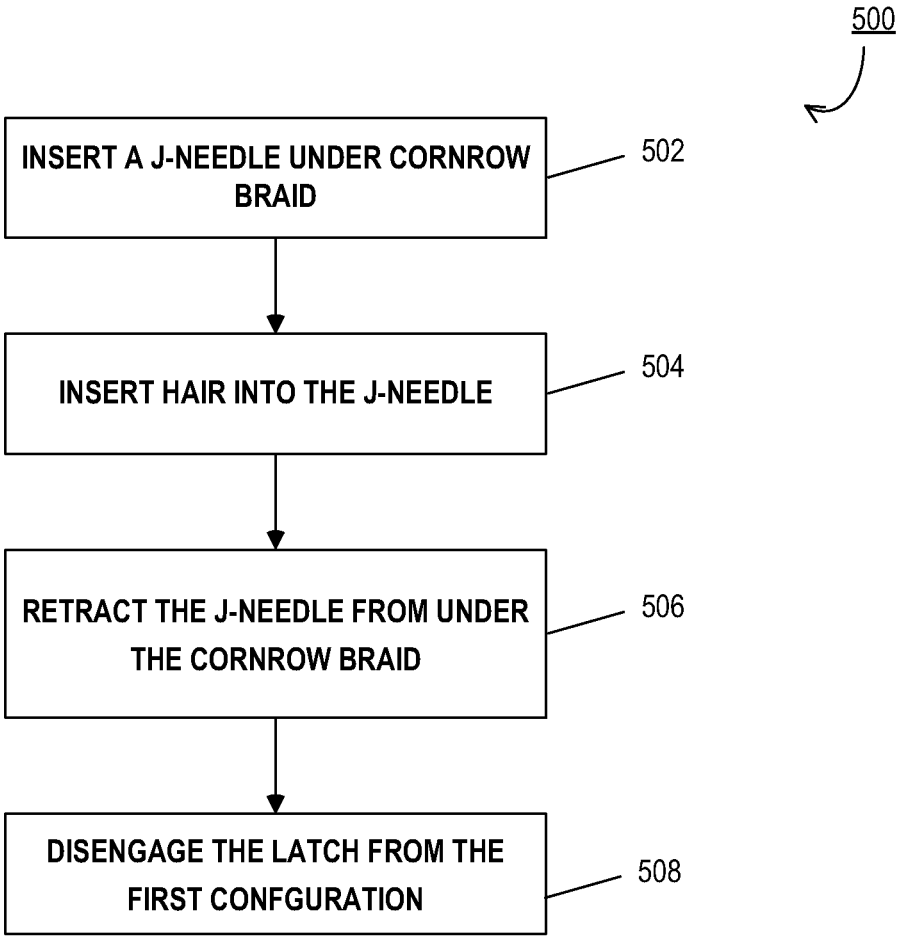
FIG. 5 is a flowchart of a method of using the apparatus for crocheting hair according to an example.

FIG. 5 illustrates a flowchart of a method 500 of using the apparatus 100 for crocheting hair according to an example.

At block 502, the J-needle 200 is detachably attached to the handle 110 using the attachment receptacle 116 and the attachment feature 204. The J-needle 200 is inserted under a cornrow braid. The latch 208 can be connected to a multi-function feature 117 via the first cable section 117*a* and the second cable section 117*b*, such that activating the multi-function feature 117 can manipulate the latch 208 from a second configuration to a first configuration. The multi-function feature 117 is not activated.

At block 504, hair extensions are within the hook 206 on the J-needle 200, and the multi-function feature 117 is activated such that activating the multi-function feature 117 manipulates the latch 208 from a second configuration to a first configuration, thus securing the hair extensions.

At block 506, the J-needle 200 is retracted from under the cornrow braid pulling the secured hair extensions under the cornrow braid.

At block 508, the multi-function feature 117 is deactivated such that the latch 208 is manipulated from the first configuration to the second configuration. The detachable member 120 can be detached from the handle 110 such that the attachment receptacle 116 associated with the handle 110 and the attachment feature 124 associated with the detachable member 120 are detached. The detachable member 120 can be detached from the handle 110 such that the detachable member 120 from the handle 110 such that the connection receptacle 116*a* associated with the handle 110 and the connection feature 124*a* associated with the detachable member 120 are detached. The detachable member 120 can be placed within the cavity 118 of the handle 110; and an enclosure 114 can be attached to the cavity 118 or the handle 110.

In the method 500, the latch 208 moving to a first configuration upon the activation of the multi-function feature 117 and a second configuration upon deactivating the multi-function feature 117 provides a unique advantage in that it minimizes the number of activation and deactivation steps the user is required to perform when crocheting the hair extensions under the cornrow braids.

It is further contemplated that method 500 can be performed using other detachable member examples disclosed herein, for example, S-needle detachable member 250 and it's corresponding elements including latch 258, hook 256, and attachment feature 254.

Certain examples and implementations of the disclosed technology are described above with reference to block and flow diagrams of systems and methods and/or computer program products according to examples or implementations of the disclosed technology. It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams can not necessarily need to be performed in the order presented, can be repeated, or can not necessarily need to be performed at all, according to some examples or implementations of the disclosed technology.

Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, can be implemented by special-purpose, hardware-based computer systems that perform the specified functions, elements or steps, or combinations of special-purpose hardware and computer instructions.

In this description, numerous specific details have been set forth. It is to be understood, however, that implementations of the disclosed technology may be practiced without these specific details. In other instances, well-known methods, structures and techniques have not been shown in detail in order not to obscure an understanding of this description. References to "one embodiment," "an embodiment," "some embodiments," "example embodiment," "various embodiments," "one implementation," "an implementation," "example implementation," "various implementations," "some implementations," etc., indicate that the implementation(s) of the disclosed technology so described may include a particular feature, structure, or characteristic, but not every implementation necessarily includes the particular feature, structure, or characteristic. Further, repeated use of the phrase "in one implementation" does not necessarily refer to the same implementation, although it may.

Throughout the specification and the claims, the following terms take at least the meanings explicitly associated herein, unless the context clearly dictates otherwise. The term "connected" means that one function, feature, structure, or characteristic is directly joined to or in communication with another function, feature, structure, or characteristic. The term "coupled" means that one function, feature, structure, or characteristic is directly or indirectly joined to or in communication with another function, feature, structure, or characteristic. The term "or" is intended to mean an inclusive "or." Further, the terms "a," "an," and "the" are intended to mean one or more unless specified otherwise or clear from the context to be directed to a singular form. By "comprising" or "containing" or "including" is meant that at least the named element, or method step is present in article or method, but does not exclude the presence of other elements or method steps, even if the other such elements or method steps have the same function as what is named.

As used herein, unless otherwise specified the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

As used herein, unless otherwise specified the use of the adjective "secure", "secured," etc., is intended to mean non-permanently fixed or fastened so as not to give way, become loose, or be lost.

While certain examples of this disclosure have been described in connection with what is presently considered to be the most practical and various examples, it is to be understood that this disclosure is not to be limited to the disclosed examples, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain examples of the technology and also to enable any person skilled in the art to practice certain examples of this technology, including making and using any apparatuses or systems and performing any incorporated methods. The patentable scope of certain examples of the technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An apparatus comprising:

a handle comprising:
- a first end;
- a second end;
- a connection receptacle;
- a threaded attachment receptacle located at the first end of the handle; and
- a cavity located within the handle, the cavity comprising an opening located at the second end of the handle; and a detachable member comprising:
- a threaded attachment feature;
- a needle comprising a first end, a second end, and a first bend;
- a hook disposed on the first end of the needle; and
- a latch disposed on the first end of the needle;
- wherein the threaded attachment feature of the detachable member is disposed on the second end of the needle;
- wherein the latch is configurable between a first configuration and a second configuration; and
- wherein the cavity is dimensioned to store the detachable member when detached from the handle;

wherein the detachable member is releasably attached to the handle via threadable engagement between the threaded attachment feature with the threaded attachment receptacle of the handle.

2. The apparatus of claim 1 further comprising an enclosure configured to cover the opening of the cavity.

3. The apparatus of claim 1, wherein the handle further comprises a multi-function feature in communication with a motion-transformer.

4. The apparatus of claim 3 further comprising a first cable section configured to adjustably connect the motion-transformer to the connection receptacle;

wherein activation of the multi-function feature actuates the first cable section.

5. The apparatus of claim 1, wherein the latch is in the first configuration when in communication with the hook, and is in the second configuration when not in communication with the hook.

6. The apparatus of claim 1 further comprising a second cable section in communication with the threaded attachment feature and the latch.

7. The apparatus of claim 1, wherein the needle further comprises a second bend disposed on the second end of the needle thereby forming an S shape.

8. An apparatus for crocheting hair extensions comprising:

a handle comprising:

a first end;

a second end;

a connection receptacle;

a multi-function feature in communication with a motion-transformer;

a cavity located within the handle comprising an opening disposed on the second end of the handle; and a threaded attachment receptacle disposed on the first end of the handle;

a detachable member comprising a threaded attachment feature and a latch;

an enclosure dimensioned and configured to cover the opening of the cavity;

a first cable section configured to adjustably connect the motion-transformer to the connection receptacle; and a second cable section in communication with the threaded attachment feature and the latch;

wherein the detachable member is releasably attached to the handle via threadable engagement between the threaded attachment feature of the detachable member with the threaded attachment receptacle of the handle;

wherein activation of the multi-function feature actuates the first cable section; and wherein the cavity is dimensioned to store the detachable member when detached from the handle.

9. The apparatus of claim 8, wherein the detachable member further comprises:

a needle comprising a first end, a second end, and a first bend; and a hook disposed on the first end of the needle;

wherein the latch is disposed on the first end of the needle; and wherein the threaded attachment feature is disposed on the second end of the needle.

10. The apparatus of claim 9, wherein the needle further comprises a second bend disposed on the second end of the needle.

11. The apparatus of claim 8, wherein:

the detachable member further comprises:

a needle comprising a first end, a second end, a first bend and a second bend, thereby forming an S shape; and a hook disposed on the first end of the needle;

the handle further comprises a grip feature disposed on a ventral surface of the handle;

the multi-function feature is selected from the group consisting of a button, a slider, a key, a lever, a wheel, and a combination thereof;

the latch is disposed on the first end of the needle and is configurable between a first configuration and a second configuration;

the latch is in the first configuration when in communication with the hook, and is in the second configuration when not in communication with the hook; and the threaded attachment feature is disposed on the second end of the needle.

12. The apparatus of claim 11, wherein the grip feature comprises one or more grip elements selected from the group consisting of:

grooves or contours that are disposed on the ventral surface of the handle;

a compliant material disposed on the handle that changes shape in response to pressure to conform around the shape of a pressure-applying article;

ribs, ridges, perforations, slots, holes, baffles, threads, decals, tapers, engravings, stamps, reliefs, dimples, indentations;

and a combination thereof.

13. The apparatus of claim 8, wherein:

the detachable member further comprises:

a hollow J-needle comprising a first end, a second end, a first bend, an undeployed length, and a deployed length; and a hook disposed on the first end of the J-needle;

the J-needle having an adjustable length between the undeployed length and the deployed length with adjustment via telescoping or folding;

the deployed length of the J-needle is less than a length of the handle;

the handle further comprises a grip feature disposed on a ventral surface of the handle;

the multi-function feature is selected from the group consisting of a button, a slider, a key, a lever, a wheel, and a combination thereof;

the latch is disposed on the first end of the J-needle and is configurable between a first configuration and a second configuration;

the latch is configurable between a first configuration and a second configuration;

the latch is in the first configuration when in communication with the hook, and is in the second configuration when not in communication with the hook; and the threaded attachment feature is disposed on the second end of the J-needle.

* * * * *